US008850737B1

(12) United States Patent
Rogers

(10) Patent No.: US 8,850,737 B1
(45) Date of Patent: Oct. 7, 2014

(54) CLEANING AND POLISHING TOOL FOR FIREARM BOLTS

(71) Applicant: William H. Rogers, St. Augustine, FL (US)

(72) Inventor: William H. Rogers, St. Augustine, FL (US)

(73) Assignee: Prezine, LLC, Jacksonville, FL (US)

( * ) Notice: Subject to any disclaimer, the term of this patent is extended or adjusted under 35 U.S.C. 154(b) by 0 days.

(21) Appl. No.: 13/854,683

(22) Filed: Apr. 1, 2013

(51) Int. Cl.
*F41A 29/02* (2006.01)
*B08B 9/023* (2006.01)

(52) U.S. Cl.
CPC ..... *F41A 29/02* (2013.01); *B08B 9/023* (2013.01)
USPC ..... 42/90; 15/104.04

(58) Field of Classification Search
USPC ..... 42/90, 108, 95; 15/104.04, 236.06
See application file for complete search history.

(56) References Cited

U.S. PATENT DOCUMENTS

| | | | | | |
|---|---|---|---|---|---|
| 490,682 | A * | 1/1893 | Roemer | 15/191.1 |
| 1,593,542 | A * | 7/1926 | Shoemaker | 15/104.04 |
| 2,204,516 | A * | 6/1940 | Stone | 15/236.06 |
| 2,404,507 | A * | 7/1946 | Link | 15/104.011 |
| 4,014,063 | A * | 3/1977 | Bunke | 15/111 |
| 4,439,884 | A * | 4/1984 | Giorni | 15/104.92 |
| 4,887,508 | A * | 12/1989 | Bianco | 86/23 |
| 5,482,756 | A * | 1/1996 | Berger et al. | 428/36.2 |
| 7,644,529 | B2 * | 1/2010 | Hopper et al. | 42/90 |
| 8,528,144 | B2 * | 9/2013 | Oselinsky et al. | 15/105 |
| 2004/0031112 | A1 * | 2/2004 | Saurer | 15/88 |
| 2004/0216254 | A1 * | 11/2004 | Ueberall | 15/104.04 |
| 2012/0186127 | A1 * | 7/2012 | Shipman et al. | 42/95 |

* cited by examiner

*Primary Examiner* — Reginald Tillman, Jr.
(74) *Attorney, Agent, or Firm* — Arthur G. Yeager

(57) ABSTRACT

Firearm bolt tail cleaning device has a device body and a plurality of cleaning arms arranged radially about a centerline and defining a cleaning slot configured to accept a bolt tail. The cleaning device slidably and rotatably interfaces with the bolt tail at inner wall portions of the plurality of cleaning arms, to remove debris from and to polish the bolt tail surface. The device is constructed of a polymer and 15 to 40 percent by weight of an abrasive material, such as glass fiber. Via interaction with the bolt tail, at least a portion of the plurality of cleaning arms become worn with use and expose more abrasive material which facilitates removing debris from and polishing the bolt tail surface. End portions of the body are open and each have a concavity.

19 Claims, 4 Drawing Sheets

CLEANING AND POLISHING TOOL FOR FIREARM BOLTS

CROSS-REFERENCE TO RELATED APPLICATION

This application claims the benefit of U.S. Design patent application 29/444,690, filed Feb. 1, 2013, and entitled "Carbon Removal and Polishing Tool for Rifle Bolts," the entire contents of which are incorporated herein by reference.

FIELD OF THE INVENTION

The present disclosure relates to firearm cleaning devices for semiautomatic and fully automatic firearms, and more particularly to devices for removing debris from firearm bolt tails of a breech bolt of the AR-15, an M-16 or derivatives thereof and polishing the same.

BACKGROUND

Gas operated firearms are efficient but require frequent maintenance. Build ups of debris such as vaporized metals, carbon, and other impurities on the bolt, particularly the bolt tail, may cause the firearm to foul if the debris is not routinely removed.

In gas impingement systems like those found in the AR-15, gas operated firearms extract spent casings and load a new cartridge in the chamber by harnessing energy from high pressure gases generated during firing. High pressure gas is siphoned off from the barrel after a fired bullet passes a gas port. Gas enters the gas port, travels down a gas tube, typically located above the barrel, and into a gas key. The gas key channels the gas into the bolt carrier. The bolt carrier houses the bolt, forming a piston powered by the high pressure gases. The high pressure gas impinges upon the bolt tail, causing the bolt and bolt carrier to move and cycle through the chambering operation.

In order to efficiently transfer the energy contained in the high pressure gas to other portions of the bolt carrier assembly, the bolt tail comprises a bolt tail top and a bolt tail body. Both portions have circular cross sections. The bolt tail top has a concave curvature, having a larger diameter at a first end which curves down to a smaller diameter at a second end where the bolt tail top connects with the cylindrical bolt tail body. In order to ensure proper functionality and reliability, debris must be removed from both portions of the bolt tail and both portions must be polished.

Several debris removal approaches exist. The usual method to clean the bolt tail is to scrape it with a sharp metal object followed by brushing with various solvents and compounds to finally clean and polish the part.

Various tools have been designed to make this task easier. A product called a "Carbon Removal Tool" manufactured by Magna-matic of Waldo, Wis. discloses an adjustable metal scraper featuring a pin which is inserted into the bolt, allowing the adjustable metal scraper to be held against the bolt tail and rotated, thereby removing debris from the bolt tail. This design is disclosed in U.S. Pat. No. 8,327,571 (the '571 patent).

Another approach is disclosed in U.S. Patent Application Publication No. 2011/0113669 (the '669 Application) wherein the bolt tail is first inserted into a channel and rotated against an adjacent scraper blade.

Known cleaning and polishing tools, including those disclosed in the '571 patent and the '669 Application, require a final action to remove the last remaining residue. For example, devices in accordance with the '669 Application accomplish the final cleaning and polishing action by having a user place a polishing pad around the bolt tail and inserting the assembly into an adjustable polishing arm guide hole. The user may press a polishing arm down on the bolt tail and rotate the bolt in order to complete the cleaning process. Additional compounds can be used to facilitate this action.

Existing bolt tail cleaning and polishing solutions are relatively large, making them difficult to carry in a cleaning kit. In fact, many existing devices are larger than the bolt itself. Additionally, existing bolt tail cleaning devices require two separate processes to clean and polish the bolt tail. The first process is used to scrape away the majority of the debris deposited on the bolt tail. The second process is required to fully clean and polish the bolt tail surface.

Given the foregoing, what is needed are devices which remove debris from the bolt tail of a firearm and polish the bolt tail in a single process. Additionally, durable devices are needed which have a small footprint, preferably smaller than a bolt, in order to facilitate carrying the bolt tail cleaner in a cleaning kit. In sum, what is needed is a is a cost effective, durable, portable device which, via a single process, removes debris and polishes the bolt tail, thereby enabling more rapid and complete cleaning of the bolt tail both in the barracks and in the field.

BRIEF SUMMARY OF THE INVENTION

The present disclosure is directed to firearm bolt tail cleaning devices which remove debris from a bolt tail and polish the bolt tail via a single process. Devices in accordance with the present disclosure may be used to clean portions of bolts for gas operated autoloading firearms such as the AR-15, derivatives of the AR-15 platform, the M-16, and other semi-automatic and automatic firearms.

In some aspects of the present disclosure, the cleaning device comprises a device body configured to rotatably and slidably interface with a bolt tail via a plurality of cleaning arms. The plurality of cleaning arms extend inward toward a centerline and define a cleaning slot. The bolt tail may be inserted into the cleaning slot. The bolt and the cleaning device may then be rotated with respect to one another about a common centerline, causing the cleaning arms to remove debris from the bolt tail. The cleaning arms, when the device is injection molded, comprise 15-40 percent by weight of an abrasive material, such as glass fiber, which facilitates both debris removal and polishing of the bolt tail surface. Debris exits the cleaning device via debris removal channels defined by the radial spacing of the plurality of cleaning arms.

Further features and advantages of the devices and systems disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION OF THE INVENTION

The present disclosure is directed to firearm bolt tail cleaning devices which remove debris from a bolt tail and polish the bolt tail via a single process. Devices in accordance with the present disclosure may be used to clean portions of bolts for gas operated autoloading firearms such as the AR-15, derivatives of the AR-15 platform, the M-16, and other semi-automatic and automatic firearms.

Figure 1:
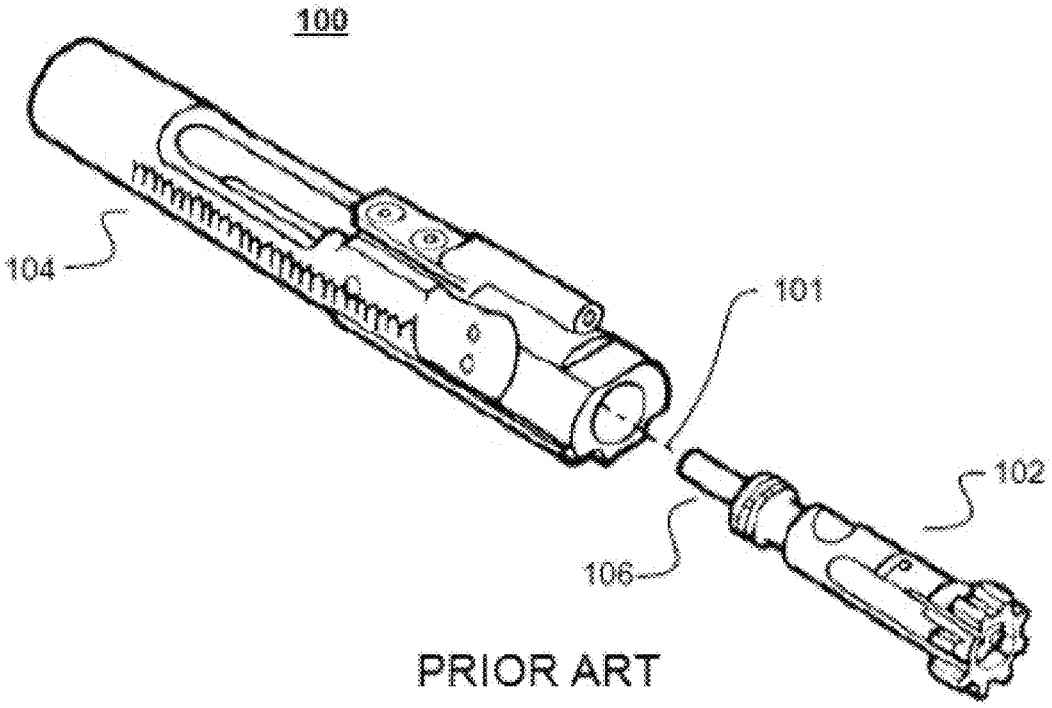
PRIOR ART FIG. 1
FIG. 1 is an exploded, perspective view of a bolt assembly, accordance with the prior art.

Referring now to FIG. 1, an exploded, perspective view of a prior art bolt assembly 100 is shown.

In gas-operated autoloading systems like those found in the AR-15, gas operated firearms extract spent casings and load a new cartridge into the chamber or otherwise prepare the cartridge for firing by harnessing energy from high pressure gases generated during firing. High pressure gas is siphoned off from the barrel and injected into a bolt carrier assembly 100. Bolt carrier assembly acts as a piston and includes a bolt carrier 104 and a bolt 102. The bolt comprises a bolt tail 106. The high pressure gas impinges upon bolt tail 106 at bolt tail surface 202 (shown in FIG. 2), causing bolt carrier assembly 100 to move and cycle through the chambering operation.

Figure 2:
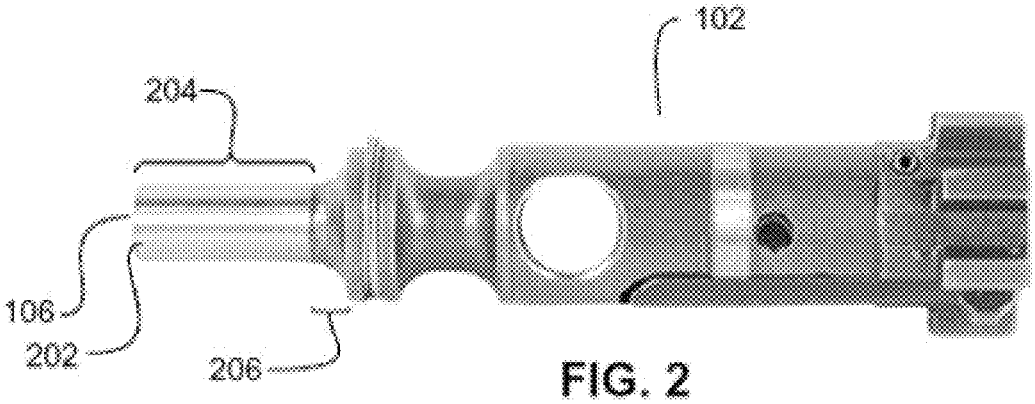
FIG. 2 PRIOR ART
FIG. 2 is a side elevational view of the prior art a firearm bolt.

Referring now to FIG. 2, a side view of prior art bolt 102 is shown.

In order to efficiently transfer the energy contained in the high pressure gas to other portions of bolt carrier assembly 100, bolt tail 106 includes a bolt tail top 206 and a bolt tail body 106. In an aspect, bolt tail top 206 and bolt tail body 204 have circular cross sections. Bolt tail top 206 has a concave curvature, having a larger diameter at a first end which curves down to a smaller diameter at a second end where bolt tail top 206 connects with cylindrical bolt tail body 204.

In order to ensure proper functionality and reliability, debris must be removed from both portions of bolt tail 106 and both portions must be polished. The high pressure exhaust gases which power the gas-operated autoloading process are combustion gases. The gases comprise vaporized metals, carbon, incomplete combustion products, oxides, particulates, and other impurities contained in the ammunition propellants. These materials impinge on bolt tail 106 causing debris to build up, which must be regularly removed in order for the firearm to continue to function properly.

The profile of bolt tail 106 may vary, depending on the overall configuration of the firearm and bolt 102. In an aspect, bolt tail top 206 may have a gradual slope from the narrow radius of bolt tail body 204 to the larger radius of the remainder of bolt 102. In another aspect, bolt tail top 206 may be steeply sloped. In yet another aspect, bolt tail top 206 is not sloped. Rather, bolt tail top 206 may be oriented at a right angle or near-right angle to bolt tail body 204.

Figure 3:
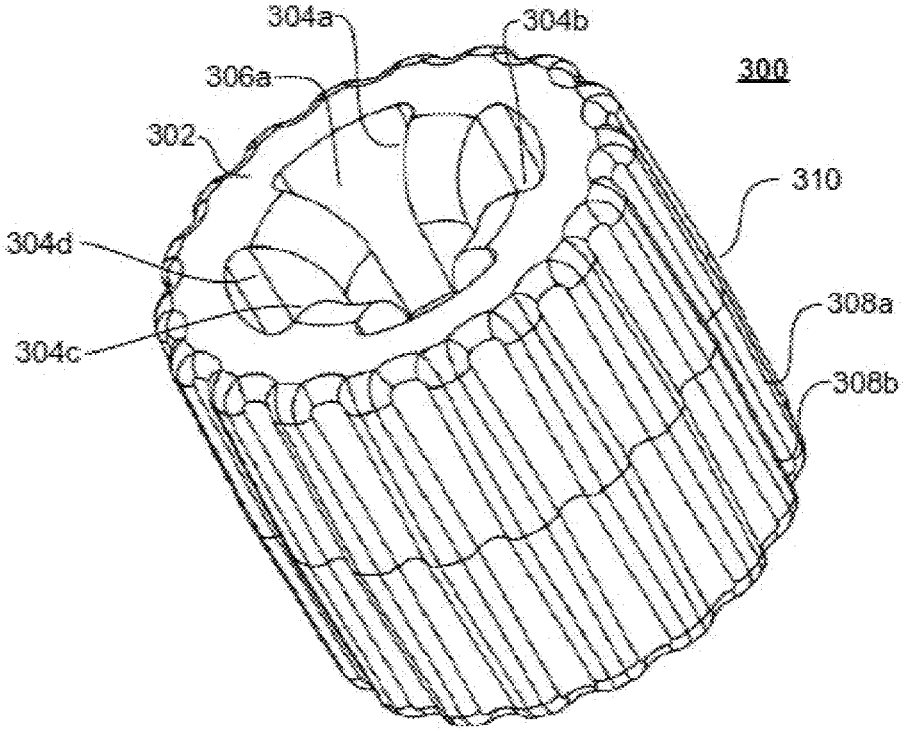
FIG. 3 is a perspective view of a bolt tail cleaning device, in accordance with the present invention.
Figure 4:
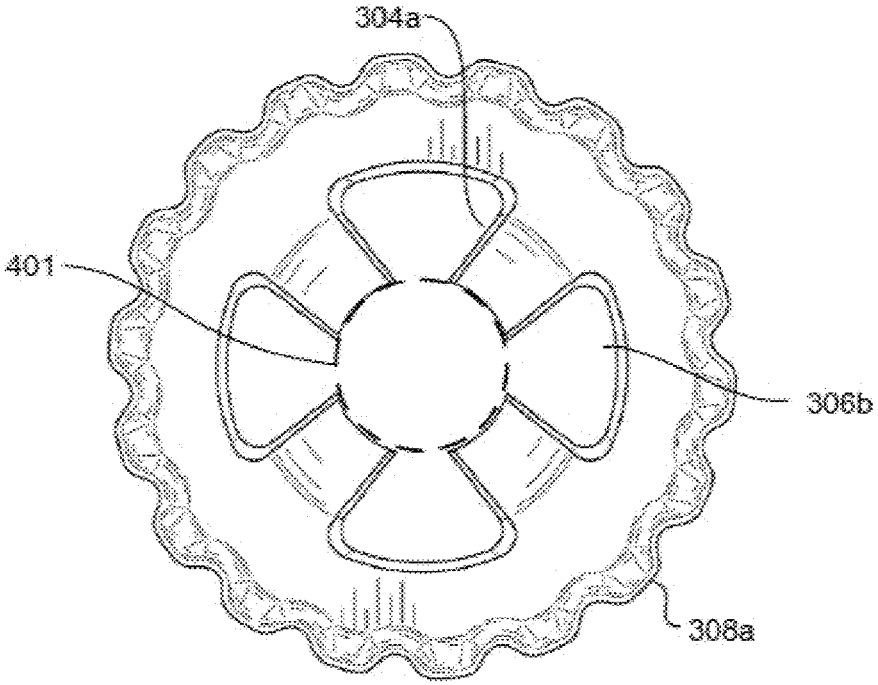
FIG. 4 is a front end view of a bolt tail cleaning device, in accordance with the present invention.

Referring now to FIGS. 3 and 4, various views of a bolt tail cleaning device 300, namely a perspective view and a front view, in accordance with various aspects of the present disclosure, are shown.

Bolt tail cleaning device 300 includes a unitary device body 302 and a cleaning slot 401 (shown in FIG. 4). Bolt cleaning device 300 is preferably formed via injection molding using a variety of high grade polymers. Bolt cleaning device may be constructed via other means and from other materials apparent to those having skill in the relevant art(s) after reading the description herein. As discussed in more detail below, in various aspects of the present disclosure, the materials used in the construction of bolt tail cleaning device 300 may be mixed, doped, or otherwise contain 15-40 percent by weight of an abrasive material, preferably glass fibers adapted to facilitate cleaning and polishing of bolt tail 106. Bolt tail 102 is inserted into cleaning device 300 at cleaning slot 401. Cleaning slot 100 may be a circular opening in cleaning device 300, having a radius substantially similar to the radius of bolt tail body 204. In an aspect, cleaning slot 401 is a circular opening having dimensions substantially commensurate with the bolt tail body 204. In another aspect, cleaning slot 401 is an opening running the length of cleaning device 300. In yet another aspect, cleaning slot 401 is an opening accessible from only one end of cleaning device 300 (e.g., the end facing upward in FIG. 3). Cleaning slot 401 may be an opening configured to accept bolt tail 106 from both directions along the length of cleaning slot 401.

Device body 302 is a substantially rigid member including a plurality of cleaning arms 304 (labeled as cleaning arms 304*a-d* in FIG. 3). Cleaning arm 304 extends inward toward an axial centerline (not labeled in FIG. 3). Cleaning arm 304 is configured to slidably and rotatably interface with bolt tail 106 at bolt tail surface 202 such that cleaning arm 304 removes debris from bolt tail surface 202 and polishes bolt tail surface 202. The plurality of cleaning arms 304 define cleaning slot 401. Device body 302 may comprise two, three, four, or more cleaning arms 304. In some aspects, cleaning arms 304 are evenly spaced about the axial centerline.

Cleaning arm 304 removes debris from bolt tail 106 via scraping action. In an aspect, cleaning arm 304 has sharp edges positioned adjacent to and interfacing with bolt tail surface 202 when bolt tail 106 is placed in cleaning slot 401. Cleaning arm 304 is constructed of a material comprising an abrasive material such as glass fiber. The abrasive material may contact bolt tail surface 202 and further facilitate removal of debris and polishing of bolt tail surface 202 when the major portion of the debris has been removed.

The plurality of cleaning arms 304 form a plurality of debris removal channels 306 (labeled as channels 306*a-d* in FIG. 3). Cleaning arms 304 remove debris from bolt tail surface 202 and the debris is pushed into channels 306 running the length of cleaning device 300. Debris exits cleaning device 300 at the ends of cleaning device 300 via channel 306. Solvents and other materials which facilitate removal of debris from bolt tail 106 and polishing of bolt tail 106 may be injected or otherwise placed within cleaning device at channel 306. In an aspect, channel 306 is open at both ends of cleaning device 300. In another aspect, channel 306 may be open at only one end of cleaning device. In yet another aspect, channel 306 may be closed at both ends, having one or more openings along device outer surface 310.

Device body 302 is a substantially rigid, cylindrical member having a radius chosen to facilitate hand rotative operation of cleaning device 300. Device body outer surface 310 is configured to facilitate operation of cleaning device 300. In an aspect, device body outer surface 310 further includes a plurality of ridges 308 (labeled, for clarity, only as ridges 308*a-b* in FIG. 3). Such ridges 308 are evenly spaced about device body outer surface 310 and longitudinally oriented. Ridges 308 facilitate gripping, turning, and placement of cleaning device 300, especially when a user is wearing gloves or other hand coverings. In another aspect, device body outer surface 310 may be ribbed, dimpled, or have a rough texture in order to facilitate gripping and operation of cleaning device 300.

Bolt tail cleaning device 300 removes debris from bolt tail 102 via slidably interfacing with bolt tail 102. Once in place, bolt tail cleaning device 300 may be rotated and moved lengthwise along bolt tail 102, thereby removing debris from bolt tail 102 via rotatably and slidably interfacing with bolt tail 102. In an aspect, cleaning arms scrape debris from bolt tail surface 202 and polish bolt tail surface 202 via such movement. Friction forces between debris and bolt tail surface 202 also facilitated removal of debris and polishing.

Figure 5A:
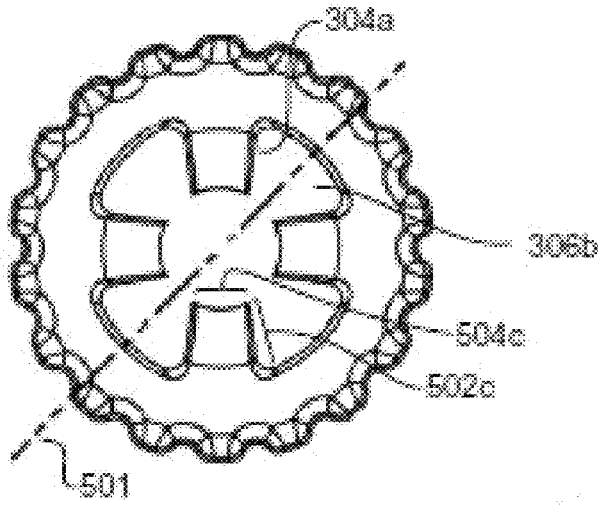
FIG. 5A is a rear end view of the bolt tail cleaning device.
Figure 5B:
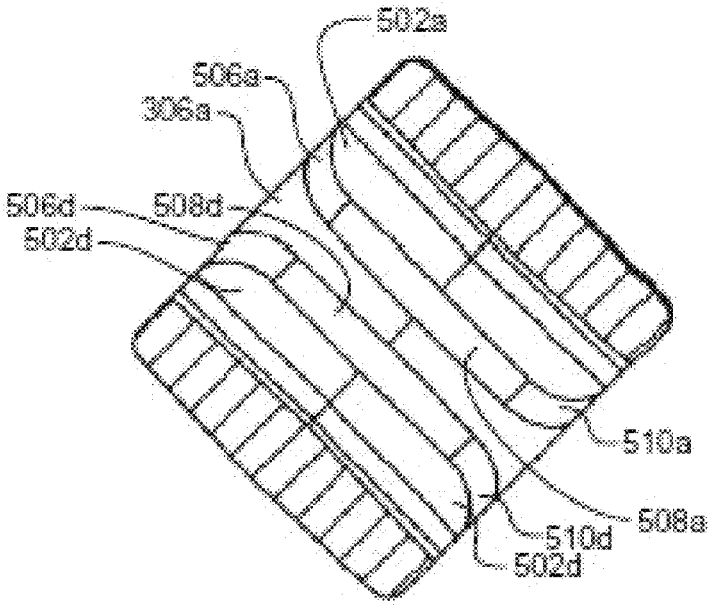
FIG. 5B is a cross sectional view taken along broken line 501 of FIG. 5A.

Referring now to FIGS. 5A & 5B, various views bolt tail cleaning device 300, namely a front view and a cross-sectional view along line 501, in accordance with various aspects of the present disclosure, are shown.

Cleaning arm 304 (labeled, for clarity, only as cleaning arm 304*a* in FIG. 5) includes a cleaning arm body (labeled, for clarity, only as cleaning arm body 502*c* in FIG. 5) and cleaning arm inner wall portion 504 (labeled, for clarity, only as cleaning arm inner wall portion 504*c* in FIG. 5). Cleaning arm body 502 extends inward toward the center of cleaning device 300, thereby positioning cleaning arm inner portion 504 to define cleaning slot 401 and interface with bolt tail 106 inserted in cleaning slot 401. Sides of the cleaning arm 304 define in part channel 306 (labeled, for clarity, only as channel 306*b* in FIG. 5) and facilitate removal of debris by providing a surface which channels the debris out of cleaning device 300.

Inner wall portion 504 may be configured to conform to portions of bolt tail 106 when bolt tail 106 is inserted into cleaning slot 401. In an aspect, inner wall portion 504 is concave, convex, or flat. In another aspect, inner portion may be ribbed, ridged, or have a rough texture in order to facilitate removal of debris from bolt tail 106. Inner wall portion 504 is worn down during operation of cleaning device 300, causing inner device to more closely conform to bolt tail 106. That is, inner wall portion 504 may initially be configured as a flat surface. Via frictional interaction with bolt tail 106 during operation of cleaning device 300, portions of inner wall portion 504 are worn away, yielding a concave surface.

Cleaning device 300 along line 501 is shown in FIG. 58. Inner wall portion 504 includes first end portion 506 (labeled as first end portion 506*a, d* in FIG. 5B), middle portion (labeled as middle portion 508*a, d* in FIG. 5B), and second end portion (labeled as first portion 510*a, d* in FIG. 5B). Curvature of end portions may conforms to the shape of bolt tail top 206. In an aspect, first end portion 506 is configured to conform to bolt tail top 206, however second end portion 510 is not configured to conform to bolt tail top 206. Second end portion 510 may be flat, rounded, or configured to facilitate turning of cleaning device 300 by hand or other manipulation. In yet another aspect, second end portion 510 is configured to scrape debris from bolt tail 106, from bolt 102, or from another portion of the firearm. In another aspect, adjacent portions of device body 302 are configured to facilitate turning of cleaning device 300 by hand or other manipulation or configured to scrape debris from bolt tail 106, from bolt 102, or from another portion of the firearm.

Middle portion 508 is configured to conform to a portion of bolt tail body 204. Middle portion 508 may be curved to conform to a portion of bolt tail surface 202. In an aspect, middle portion 508 has a concave curvature.

Figure 6:
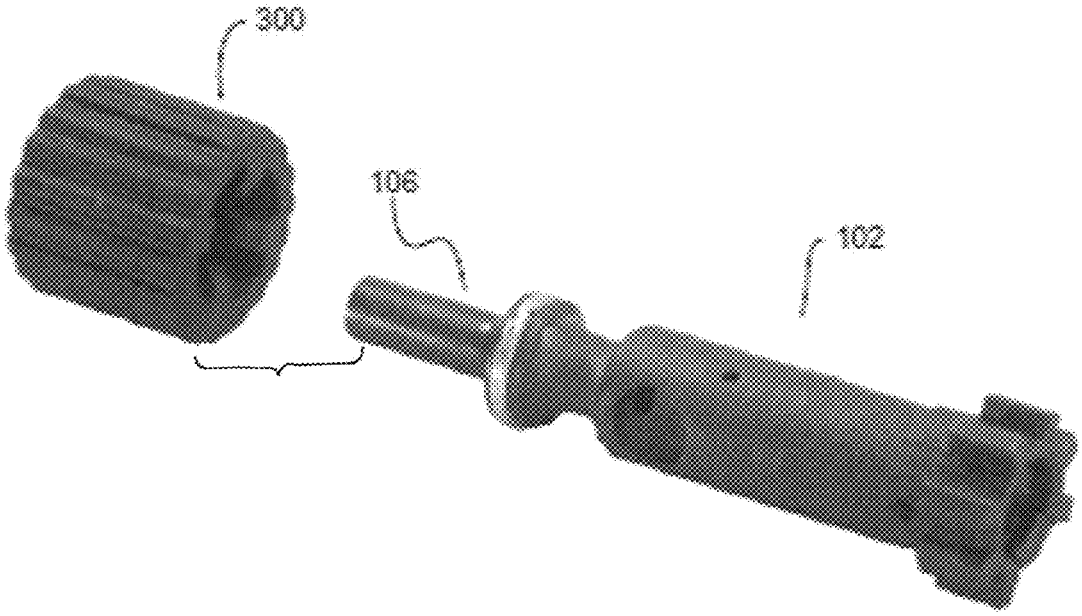
FIG. 6 is a perspective view of the bolt tail cleaning device and the prior art bolt wherein the bolt tail and the cleaning slot are aligned.

Referring now to FIG. 6, a perspective view of bolt tail cleaning device 300 and bolt 102 wherein bolt tail 106 and cleaning slot 401 are aligned.

In order to utilize cleaning device 300, bolt tail 106 is inserted into cleaning slot 401. The centerline of bolt 102 is aligned with the centerline of cleaning device 300 and bolt tail 106 is slidably inserted into cleaning device 300 at cleaning slot 401.

Figure 7:
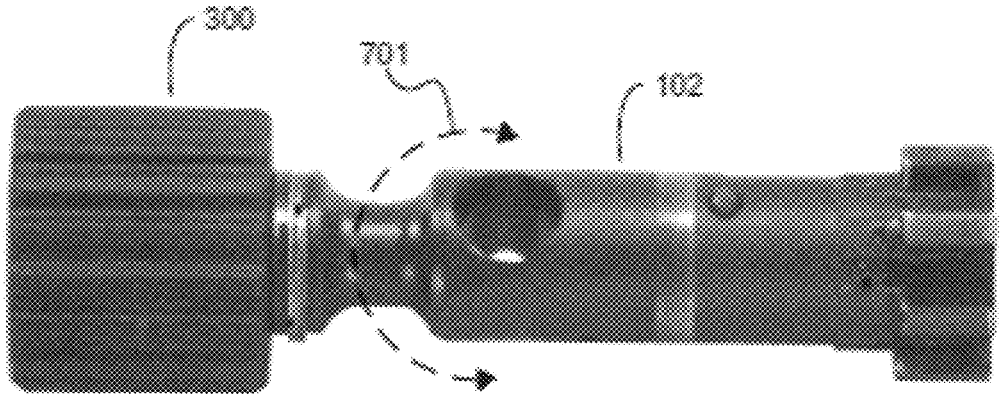
FIG. 7 is a side elevational view of the bolt tail cleaning device and a bolt with the bolt tail inserted in the cleaning slot.

Referring now to FIG. 7, a side view of bolt tail cleaning device 300 and bolt 102 wherein bolt tail 106 has been inserted in cleaning slot 401 (not shown in FIG. 7), in accordance with an aspect of the present disclosure, is shown.

As shown by rotative action broken line 701, bolt 102 and cleaning device 300 may be rotated relative to one another in order to remove debris from bolt tail 106 and polish bolt tail 106 in a single repetitive process. Bolt 102 and cleaning device 300 also move laterally relative to one another in order to remove debris and polish portions of bolt tail 106.

Cleaning arms 304 are constructed of a variety of materials. In order to facilitate cleaning and polishing of bolt tail 106, cleaning arms 304 in preferred aspects of the present disclosure are constructed of a rigid material which comprises an abrasive material. The abrasive material facilitates polishing action.

The abrasive material may be a fibrous material such as glass fiber, fiberglass, carbon fiber or graphite fiber. In an aspect, cleaning device 300 is constructed of a polymer (e.g., an injection moldable polymer) which contains 15-40 percent by weight of glass fiber. If the cleaning device were to be made by casting in a mold, the abrasive material may be a granular material such as sand, grit, silicon carbide, aluminum oxide, metal shavings, glass shards, and the like. Also, the percent by weight of the abrasive may be reduced to 5-20 percent in such a cast cleaning device.

During operation, portions of the polymer making up cleaning arm 304 is removed by frictional interaction and other erosive or ablative forces. Such removal exposes the abrasive material, facilitating debris removal and polishing of bolt tail 106. For example, where the abrasive material is glass fiber, the polymer is worn away during use exposing more and more of the embedded glass fiber. Cleaning arm 304 wears in the general shape of bolt tail surface 202 being cleaned. As this happens the exposed glass fibers act as thousands of abrasive surfaces that not only scrape away debris but also polish bolt tail surface 202. The nature of such glass fiber and polymer construction allows cleaning device 300 to be used in conjunction with cleaning solvents and compounds to enhance the cleaning operation.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

What is claimed is:

1. A firearm bolt tail cleaning device, comprising:

a unitary integrally molded device body being grippable by fingers of a hand of a user and, having:

a plurality of cleaning arms each having a cleaning arm portion extending inward toward a centerline of the device body and an inner wall portion proximally located and in parallel to the centerline and configured to contact a firearm bolt tail;

a cleaning slot defined by the plurality of cleaning arms, each of the plurality of cleaning arms extending inwardly toward the centerline and being positioned to slidably and rotatably interface with a firearm bolt tail insertable into the cleaning slot such that the plurality of cleaning arms remove debris from a firearm bolt tail surface and polish a firearm bolt tail surface; and the plurality of cleaning arms being abrasive and radially oriented about the centerline and define a plurality of debris removal channels.

2. The firearm bolt tail cleaning device of claim 1, wherein the plurality of cleaning arms are evenly spaced about the centerline.

3. The firearm bolt tail cleaning device of claim 1, wherein the unitary device body is a single cylindrical rigid member having continuous open end portions.

4. The firearm bolt tail cleaning device of claim 1, wherein the firearm bolt tail cleaning device is constructed of a polymer mixture of a polymer and an abrasive material.

5. The firearm bolt tail cleaning device of claim 4, wherein the polymer is an injection-moldable polymer.

6. The firearm bolt tail cleaning device of claim 4, wherein at least a portion of the inner wall portions are worn and removed by frictional contact between the cleaning device and interaction with a firearm bolt tail.

7. The firearm bolt tail cleaning device of claim 6, wherein the abrasive material is exposed by the frictional removal of the at least a portion of the inner wall portions and the exposed abrasive material facilitates removing debris from the firearm bolt tail surface and polishing the firearm bolt tail surface.

8. The firearm bolt tail cleaning device of claim 1, wherein the abrasive material is a fibrous material.

9. The firearm bolt tail cleaning device of claim 8, wherein the fibrous material is one of: glass fiber, fiberglass, carbon fiber and graphite fiber.

10. The firearm bolt tail cleaning device of claim 8, wherein the plurality of cleaning arms contain 15-40 percent by weight glass fiber.

11. The firearm bolt tail cleaning device of claim 4, wherein the abrasive material is a granular material.

12. The firearm bolt tail cleaning device of claim 11, wherein the granular material is one of: sand, grit, silicon carbide, aluminum oxide, metal shavings and glass shards.

13. The firearm bolt tail cleaning device of claim 1, wherein the inner wall portion comprises:

a first end portion having a curvature;

a middle portion; and a second end portion having a curvature;

wherein at least one of: the first end portion, the middle portion, and the second end portion is configured to conform to a portion of a bolt tail surface.

14. The firearm bolt tail cleaning device of claim 13, wherein a firearm bolt tail has a bolt tail top with a concave curvature; and wherein the curvature of at least one of: the first end portion and the second end portion is chosen to conform to a curvature of a firearm bolt tail top.

15. The firearm bolt tail cleaning device of claim 13, wherein a firearm bolt tail includes:

a bolt tail body having a cylindrical configuration; and wherein the middle portion of the cleaning device has a concave curvature about the centerline, conforming to a curvature of a bolt tail body.

16. The firearm bolt tail cleaning device of claim 1, wherein the device body has a circular cross section.

17. The firearm bolt tail cleaning device of claim 1, wherein the device body further includes:

a device outer surface, the device outer surface being approximately cylindrical, configured to facilitate operation of the firearm bolt tail cleaning device via hand rotation by a user, the device outer surface further including:

a plurality of spaced ridges positioned longitudinally on the device outer surface.

18. A firearm bolt tail cleaning device comprising:

a unitary device body constructed of a polymer mixture of an injection-moldable polymer and glass fiber; the device body being configured to facilitate operation of the firearm bolt tail cleaning device via hand rotation by a user and the device body having an unsmooth cylindrical device outer surface;

the device body having a plurality of cleaning arms; and a cleaning slot defined by the plurality of cleaning arms, each of the plurality of cleaning arms extending inward toward a centerline and positioned to slidably and rotatably interface with a firearm bolt tail such that the plurality of cleaning arms remove debris from a firearm bolt tail surface and polish the firearm bolt tail surface;

each cleaning arm having a cleaning arm body extending inward toward the centerline; and an inner wall portion proximally located and in parallel to the centerline and configured to contact the firearm bolt tail; and the plurality of cleaning arms being radially oriented about the centerline and being equally spaced, and defining a plurality of debris removal channels.

19. A firearm bolt tail cleaning device for cleaning and polishing a firearm bolt tail having a cylindrical bolt tail body and a bolt tail top having a concave curvature, the firearm bolt tail cleaning device comprising:

a device body constructed of a polymer mixture, having 85-60 percent by weight of an injection-moldable polymer and 15-40 percent by weight of glass fiber;

the device body being configured to facilitate operation of the firearm bolt tail cleaning device via hand rotation by a user and having a generally cylindrical outer surface, the device outer surface being ridged along a longitudinal centerline;

a plurality of elongated cleaning arms; and a plurality of cleaning slots defined by and between adjacent ones of the plurality of cleaning arms, each of the plurality of cleaning arms extending inward toward the centerline and positioned to slidably and rotatably interface with a firearm bolt tail such that the plurality of cleaning arms remove debris from a firearm bolt tail surface and polish a firearm bolt tail surface, each cleaning arm having a cleaning arm body extending inward toward the centerline;

an inner wall portion of the cleaning arm body is proximally located and in parallel to the centerline and configured to contact a firearm bolt tail, and a first end portion, and a middle portion having a concave curvature about the centerline, conforming to a curvature of a bolt tail body; and a second end portion; each of the first end portion and the second end portion having a curvature conforming to a curvature of a bolt tail top; and the plurality of cleaning arms being radially oriented about the centerline and evenly spaced, and defining a plurality of debris removal channels.

* * * * *